United States Patent [19]

McPherson

[11] 4,377,303

[45] Mar. 22, 1983

[54] CLOSURE LATCH MECHANISM IMPROVEMENTS

[76] Inventor: Bruce M. McPherson, 2342 Sunderland Rd., Maitland, Fla. 32751

[21] Appl. No.: 174,880

[22] Filed: Aug. 4, 1980

[51] Int. Cl.[3] ..... E05C 1/10

[52] U.S. Cl. ..... 292/152

[58] Field of Search ..... 292/152, 153, 107, 209, 292/DIG. 38, DIG. 61

[56] References Cited

U.S. PATENT DOCUMENTS

| | | | |
|---|---|---|---|
| 310,787 | 1/1885 | Buckley et al. | 292/152 X |
| 776,946 | 12/1904 | Ruppman | 292/153 |
| 1,653,293 | 12/1927 | Kendall | 206/1.5 |
| 3,942,630 | 3/1976 | Phillips | 206/1.5 |

FOREIGN PATENT DOCUMENTS

| | | | |
|---|---|---|---|
| 1933018 | 1/1971 | Fed. Rep. of Germany | 292/152 |
| 353769 | 8/1931 | United Kingdom . | |

*Primary Examiner*—Richard E. Moore
*Attorney, Agent, or Firm*—Roger L. Martin

[57] ABSTRACT

A closure latch mechanism has a slide component linearly movable between latched and unlatched positions, the component having a planar body portion with a flat, resiliently bendable member that is formed as an integral part of the body portion and normally located in the plane thereof. The bendable member carries a detent that is adapted and arranged for reception in a stop forming recess or aperture when the slide is at its latched position. The bendable member assumes an unstressed position in the plane of the body portion when the detent is in the recess and is in a stressed position when the slide is unlocked. The detent follows and slidably engages a surface arranged to retain the member in its stressed position as the slide component moves between its latched and unlatched positions so that the detent automatically enters the recess to lock the device when the slide returns to its locked position. One embodiment has a slide with rear and front parts that are relatively pivotally movable and a rail and slide arrangement for use in guiding the slide component along its linear path. In another embodiment, elements that are fixed to the slide component encounter slot forming edges to guide the slide component along its linear path of movement.

11 Claims, 14 Drawing Figures

CLOSURE LATCH MECHANISM IMPROVEMENTS

BACKGROUND OF THE INVENTION

The invention relates to improved closure latch mechanisms for portable containers and to improved combinations therewith.

The art abounds with latch mechanisms that are used for latching the closure components of containers to the body components thereof. Such latch mechanisms are used in securing luggage parts together, in securing business machine carrying case parts together, and in latching the closure and body parts of lunch boxes, tackle cases, and the like together among many other uses that will be apparent to those skilled in the art.

Among the problems which are encountered with conventional latch mechanisms for such portable containers is that they are often inadvertently unlatched during the handling of the containers because the mechanisms are provided with projecting parts that serve to release the latch mechanism upon slight movement along the surface of the container as the containers are being handled. Some latch mechanisms are sometimes provided with key actuated locking devices for security purposes. The use of key-type locking devices is often unnecessary and frequently not desired because the locking devices in such instances are complicated and costly to manufacture. Apart from this there are many instances where the problem is not one of security but simply one of providing a latch carrying slide component with a locking device that minimizes the probabilities of the locking device being released inadvertently during the handling of the containers.

SUMMARY OF THE INVENTION

Latch mechanisms in accord with the invention have a latch carrying slide component that is linearly movable between latched and unlatched positions and the slide component is automatically locked at its latched position so that the container parts remain secured together unit such time as the slide component locking device is released. The inventor provides a slide component which has a planar body portion and which, as an integral part of the body portion, is provided with a flat, resilient bendable member that is integrally joined to the body portion at its proximal end. The bendable member carries a detent that is received in a wall recess or aperture in the closure and which is defined by wall edges that are arranged to stop movement of the slide component at the latched position therefor. The bendable member assumes an unstressed normal position in the plane of the body component when the detent is received in the aperture or recess to lock the components. However, to release the slide component for movement from its latched position, the member has to be depressed at the outside of the container so as to carry or push the detent from the wall recess. Such movement of the resiliently bendable member through accident or inadvertence is unlikely in normal handling of the containers and even if such should happen so that the locking mechanism is released, further movement of the slide component from its latched position is required in order to unlatch the container parts. As such, if the bendable member is depressed inadvertently so as to remove the detent from the recess, the probabilities are such that the depression caused inadvertently is only momentary and such that the resilient nature of the member will cause it to return to its normal position and thus carry the detent back into the wall recess to again lock the latch carrying slide.

Certain aspects of the invention contemplate that the depressible member will at all times be held in its bent position unless the slide component is at its latched position. The resiliently bent member will thus tend to carry the detent into the recess to lock the slide component at its latched position whenever the slide component is moved into its latched position. In accord with other aspects of the invention, the slide component has front and rear parts which are integrally connected but which are nevertheless arranged so that the latch carrying part of the component is pivoted to an offset position when the container components are unlatched and at which special manipulation is thereafter required to properly position the component parts for return to the latched position for the slide component. This arrangement serves to avoid a situation where the latch becomes locked in a position while the closure component is opened and at which the container parts could be damaged by an attempted movement of the closure to its closed position. Other aspects of the invention have to do with the mounting of the slide component as will be subsequently seen.

A general object of the invention is to provide improved closure latch mechanisms for partable containers. One particular object is to provide a closure latch mechanism with a locking device that can be simply and easily manipulated to release the latch by an individual but which is not likely to be inadvertently released during normal handling of such containers. Yet another object is to provide improved closure latch mechanisms which are simple and easy to manufacture and tend to minimize the number of parts involved in the assembled structure.

BRIEF DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following description taken in connection with the accompanying drawings, wherein:

DESCRIPTION OF THE EMBODIMENTS

Figure 1:
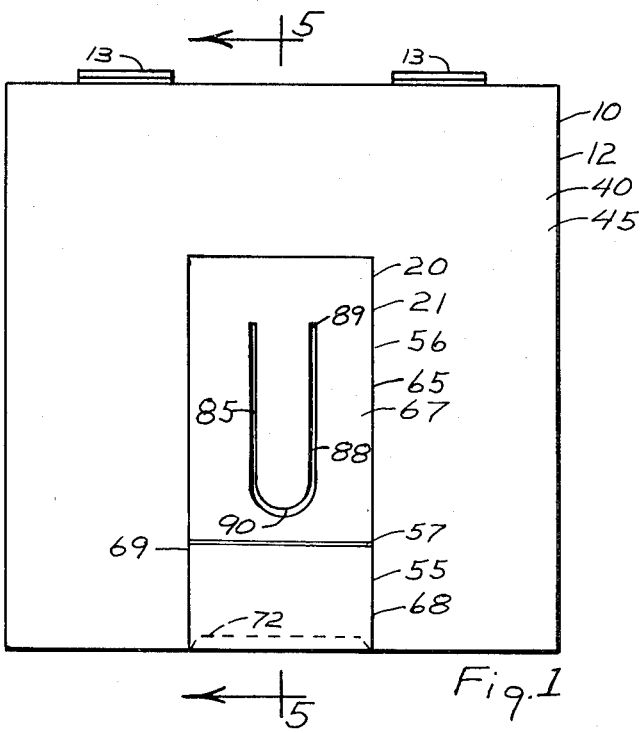
FIG. 1 is a top plan view of a portable container embodying a preferred embodiment of the invention.

Reference is now made to the drawings and more particularly to the preferred embodiment seen in FIGS. 1–7. Here the invention is seen as embodied in a hollow portable container 10 that has a body component 11 and a closure or cover component 12. The cover component 12 is pivotally mounted on the body component by a pair of hinges 13 that permit the cover to pivot between an open position 14 and a closed position 15.

Figure 5:
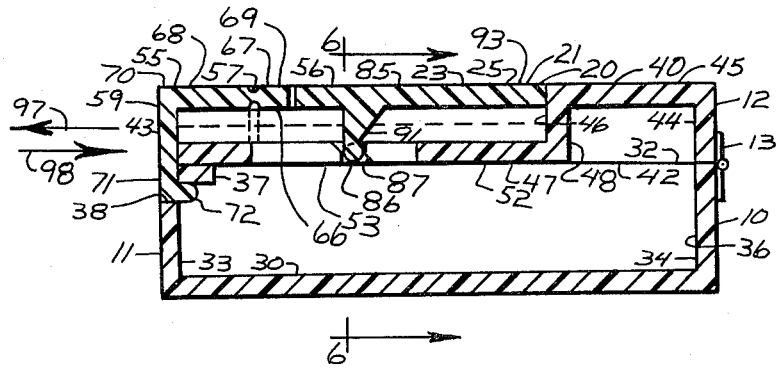
FIG. 5 is a vertical sectional view taken generally along the lines 5—5 of FIG. 1.
Figure 7:
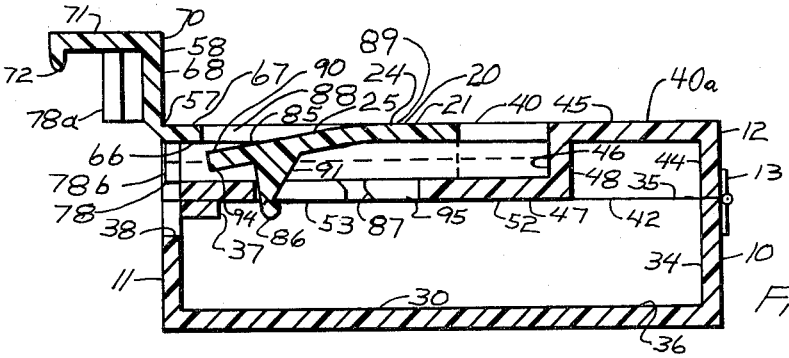
FIG. 7 is a vertical sectional view similar to that shown in FIG. 5 but with the slide component illustrated in its unlatched position.
Figure 12:
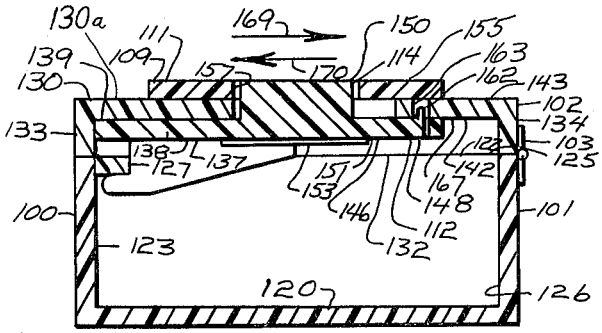
FIG. 12 is a vertical section view which illustrates the position of the slide component at its latched position.
Figure 14:
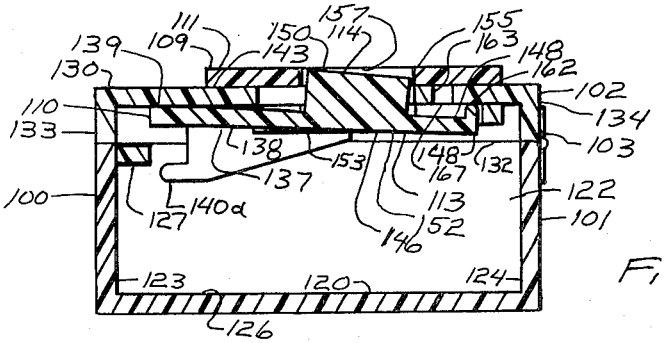
FIG. 14 is another vertical sectional view similar to that seen in FIG. 12 and which illustrates the position of the slide component at its unlatched position.
Figure 8:
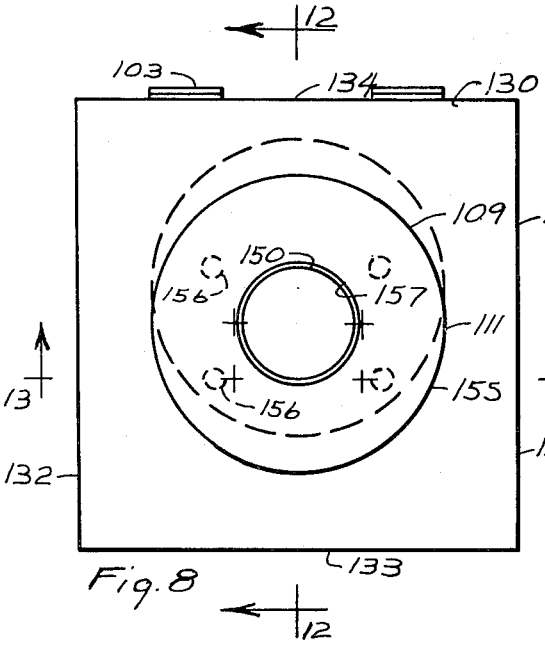
FIG. 8 is a top plan view of another portable container having a latch mechanism involving the principles of the invention.
Figure 10:
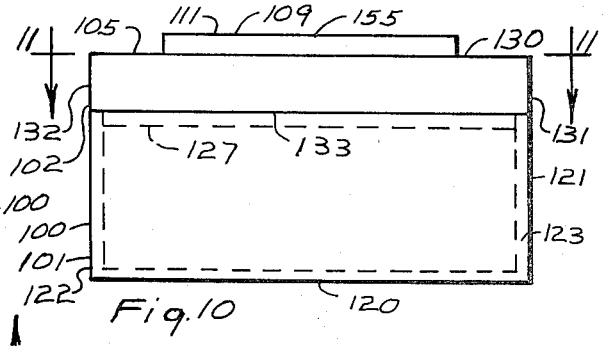
FIG. 10 is a front elevational view of the container seen in FIG. 8.
Figure 9:
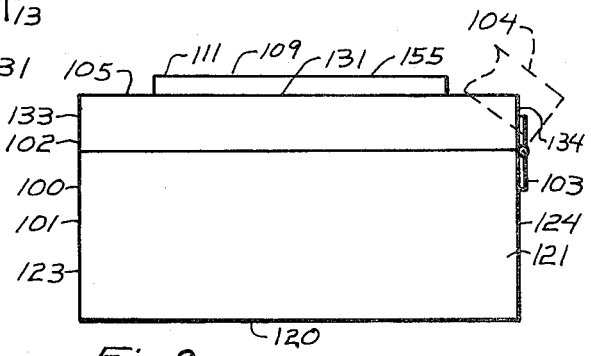
FIG. 9 is a side elevational view of the container shown in FIG. 8 and illustrates an open position for the closure in broken lines.
Figure 11:
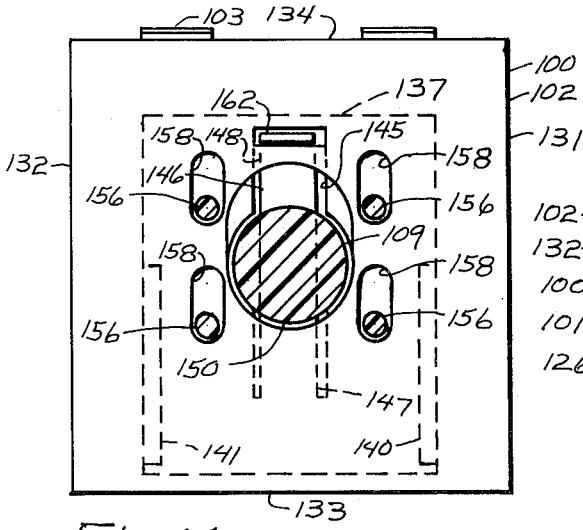
FIG. 11 is a horizontal sectional view taken generally along the lines 12—12 of the embodiment seen in FIG. 8.
Figure 13:
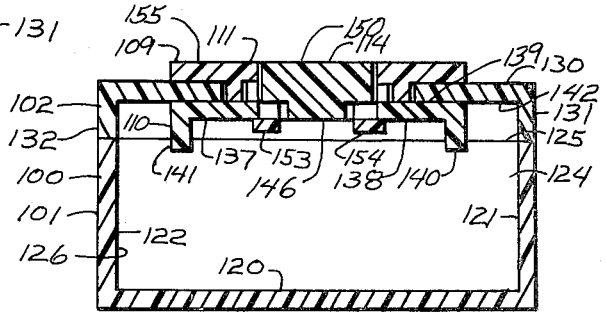
FIG. 13 is another vertical sectional view taken generally along the lines 13—13 of the embodiment shown in FIG. 8.

The cover 12 of the container 10 is equipped with a latch mechanism 20 for securing the cover 12 in its closed position 15. This mechanism 20 includes a latch carrying slide component 21, and an assembly 22 or arrangement for mounting the slide component for linear movement on the cover between latched and unlatched positions, 23 and 24, for the slide component. These slide component positions, 23 and 24, are illustrated in FIGS. 5 and 7 respectively. The mechanism 20 also has a releasable device 25 for locking the slide component 21 at its latched position 23.

The body component 11 of the container 10 is a rectangular box-like structure that includes a bottom wall 30, upright opposite side walls 31 and 32, and upright front and back walls, 33 and 34. These walls, 30–34, are integrally joined together in a one piece structure that is molded from suitable plastic material in the illustrated embodiment. At its upper end, the body component 11 has a rectangular opening 35 into the hollow interior 36 of the container component. Spanning the distance between the opposite side walls, 31 and 32, adjacent to the front wall 33 is an elongated, flat cross piece or element 37 which is fixed to these walls, 31–33, and located in the opening 35 at the front of the body component, as seen in the drawings. The front wall 33 of component 11 has an elongated aperture 38 that communicates with the component interior 36 beneath the cross piece 37. This horizontally extending aperture 38 provides a slot in the body component 11 for receiving the latch of the mechanism 20 while the cross piece 37 provides a fixed stop or catch in the body component 11 that is engaged by the latch to prevent movement of the cover from its closed position.

The cover component 12 of container 10 has a top wall 40 with an exterior side face 40, opposite side walls, 41 and 42, and front and rear walls, 43 and 44. These walls, 40—40, are integrally joined together in a one piece structure which like the body portion is molded from suitable plastic material in the illustrated embodiment. The top wall 40 of cover 12 has a flat, planar outer or exterior wall portion 45 with an upwardly opening rectangular recess 46 that also opens forwardly through the front wall 43 of the cover. The top wall 40 also has a flat, planar inner wall portion 47 which is inwardly offset from the outer portion 45 and arranged in parallel therewith. The top wall portions, 45 and 47, are integrally joined through back and opposite side inner walls, 48, 49 and 50. With wall portion 47, these inner walls 48, 49 and 50 define the recess 46 in the closure component 12.

The slide component 21 of the lach mechanism 20 is generally elongated and provided with front and rear parts 55 and 56 in the illustrated embodiment. In the process of molding the slide component 21, the parts 55 and 56 are formed integral along a line 57 at which the molded slide component 21 is subsequently heated, as by a hot wire, so as to shrink the polymeric materials along the line and provide a biasing force in the structure of the component 21 which constantly urges the front part 55 into a pivotally offset position 58 with respect to the rear part 56 of component 21. This offset position 58 for the front part 55 seen in FIG. 7 should be contrasted with aligned operating position 59 with respect to the rear part 56 that the front part 55 assumes when the cover component 12 is latched to the body component 11 of the container 10 as seen in FIG. 5.

The rear part 56 of slide component 21 has a planar body portion 65 with inwardly and outwardly facing opposite side faces 66 and 67. The front part 55 of slide component 21 also has a planar body portion 68 and this portion 68 is joined at its proximal end 69 to the body portion 65 of the rear part 56 along the heat coin line 57. The recess 46 in the top wall opens at the front of the cover through the front wall 43, and at its distal end 70, the body portion 68 of the front part 55 is integrally joined to yet another planar portion 71. This portion 71 of the front part 55 is arranged generally normal to the planar body portion 68. In addition to closing the open front end of the recess 46 when the slide component 21 is in its latched position, portion 71 of part 55 also serves as a mounting place for the latch 72 of the mechanism 20. As seen in the drawings, the latch 72 is an elongated, horizontally arranged element that is fixed to the lower end of the planar portion 71 at the interiorly facing side of the portion 71. Here, the latch is arranged in working alignment with the body component aperture 38 for receiving the latch 72.

The assembly 22 for mounting the slide component for linear movement on the cover component 12 includes a pair of elongated rail elements 75 and 76 that are laterally spaced apart and fixed to the upper side face of the top wall inner portion 47. As thus fixed to the wall portion 47, the rail elements 75 and 76 are arranged in parallel with the path of linear movement for the slide component 21 and are adapted and arranged to cooperate in guiding the slide component with a pair of elongated slide elements 77 and 78 which are laterally spaced apart and fixed to the interior side faces of the body portions 65 and 68 of the slide component. The rail elements 75 and 76 have top flanges 79 and 80 which overlap the bottom flanges 81 and 82 of the L-shaped slide elements 77 and 78. This arrangement serves to prevent the slide component 21 from moving laterally of its linear slide path as it moves between its latched and unlatched positions 23 and 24.

The slide elements 77 and 78 have a discontinuity beneath the coin line 57 so as to facilitate the pivotal movement of the front part 55 with respect to the rear part 56 of the slide component. As seen in FIGS. 5 and 7 by reference to slide element 78, each slide element has a front section 78*a* which is fixed to the inwardly facing side face of the front body portion 68 and a rear section 78*b* which is fixed to the inwardly facing side face of the rear body portion 65. As thus fixed to the body portions, the arrangement is such that the sections of each slide element are aligned when the body portions 65 and 68 are in a coplanar arrangement as seen in FIG. 5.

The locking device 25 includes an elongated, flat, depressible member 85, a detent 86 which is fixed to and movable with the member 85, and a means 87 for stopping movement of the detent 86 and thus the slide component at the latched position 23 for the slide component. The body portion 65 of the rear part 56 of the slide component has a U-shaped slot 88 that extends between the opposite side faces 66 and 67 thereof. This provides the depressible member 85 for the locking device 25 as an integral part of the body portion 65. The member 85 is integrally joined to the body portion 65 at its proximal end 89 and is resiliently deflectable from the plane of the body portion at its distal end 90 by finger pressure exerted against the member at the exterior side face 40*a* of the top wall 40.

The detent 86 is carried at the underside face 66 of the rear part of body portion 65 and is fixed to the lower end of an ear 91 which is integrally formed with the depressible member 85. The detent 86 is an elongated element as seen in the drawings and which is fixed to the ear 91 in an arrangement that is transverse of the path of linear movement for the slide component.

Figure 4:
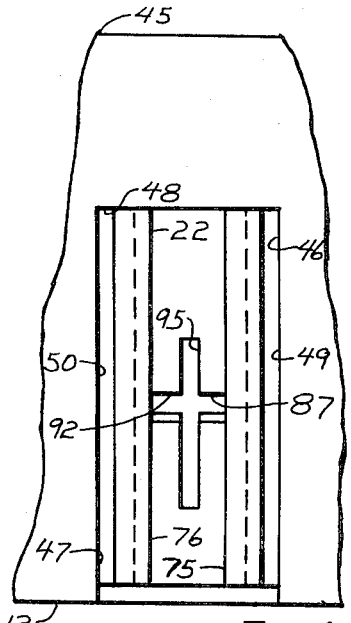
FIG. 4 is a top plan view of a fragment of the container seen in FIG. 1 and as seen with the latch carrying slide component removed from the closure component.
Figure 2:
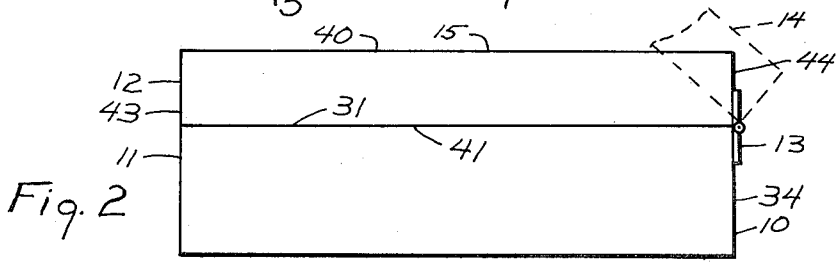
FIG. 2 is a side elevational view of the container seen in FIG. 1 with an open position for the cover component of the container being shown in broken lines.
Figure 3:
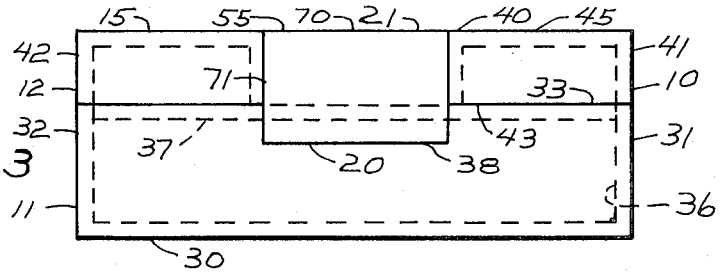
FIG. 3 is a front elevational view of the container seen in FIG. 1 with certain hidden parts being illustrated in broken lines.
Figure 6:
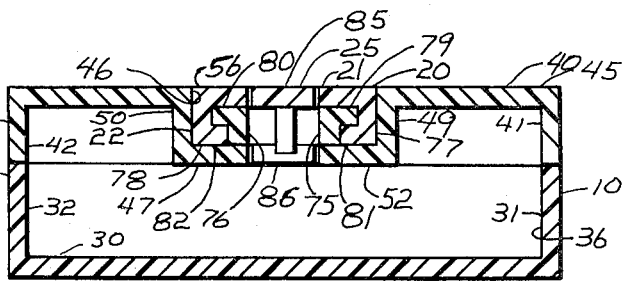
FIG. 6 is a vertical sectional view taken generally along the lines 6—6 of FIG. 5.

The inner wall portion 47 of closure top wall 40 is provided with an aperture 92 that extends between the interiorly and exteriorly facing side faces of the wall portion 47. The aperture 92 is arranged to receive the detent 86 when the slide component 21 is at its latched position 23. When the detent 86 is received in the aperture 92, the flat, depressible member 85 is in its normal unstressed position 93 in the plane of the body portion 65 and the slide component 21 is locked against movement along the linear path. The detent 86, under such circumstances, is suspended from the member 85 between the wall portion edges 87 that define the aperture 92 and these edges 87 serve to stop and/or arrest movement of the detent 86 along the path of movement for the slide component. To unlock the slide component 21, the member 85 is depressed at the outwardly facing side face 67 of the body portion 65 by finger pressure so as to bend the resilient member 85 to its bent position 94. At this position, the distal end is laterally offset inwardly of the plane of the body portion 65 and of the exterior side face 40*a* of the top side wall 40. As the member is depressed to its bent position, the detent 86 is withdrawn or pushed from the transverse aperture 92 to a position at the underside 52 of the wall portion 47. This unlocks and frees the slide component for movement to its unlatched position 24. The detent retaining and movement stopping edges 87 of the wall portion 47 have appropriately beveled corners to accommodate arcuate movement of the detent 86 during depression and return of the depressible member 85. The arrangement is nevertheless such as to provide a snug fit that stops any appreciable movement of the slide component 21 while the detent is in the component locking position in the aperture 82. The inner wall portion 47, in this respect, also has a longitudinally extending slot 95 which is parallel with the linear path of movement for the slide component and which is provided to accommodate the movement of the detent carrying ear 91 between the latched and unlatched positions 23 and 24 for the slide component 21. This slot 95 intersects the transversely arranged slot of aperture 92 for the detent, as best seen in FIG. 4.

As the slide component 21 is moved out of its latched position, the depressing finger pressure on the member 85 may be released. When this happens, the detent 86 comes to rest against the surface 53 at the underside 52 of the wall portion 47. Here, the arrangement is such that the detent 86 thereafter follows and remains in sliding contact with the surface 53 as the slide component is moved between its latched and unlatched positions 23 and 24. This causes the member 85 to be retained at its bent or stressed position 94 so that upon return of the slide component 21 to its latched position, the member 85 is urged to automatically return to its normal unstressed position 93 and to thereby automatically carry the detent into its locked position in the aperture 92.

Operationally, when the cover 12 is latched in its closed position 15, the slide component 21 is locked at its latched position 23 and the latch 72 is located in the aperture 38 of the container body component 11. To release the latch, the distal end 30 of member 85 is depressed or pushed inwardly by a finger so as to move the detent 86 from the aperture 92 in the inner wall portion 47 to a position at the underside 52 thereof and at which the bendable member assumes its bent position 94. Under such 21 is fully seated in the wall recess 46 as at the locked position 23. As the component 21 enters this position 23, the latch 72 enters the body aperture 38 to lock the cover 12 on the body 11 of the container and the detent 86 is urged into the wall recess or aperture 92. This, of course, happens as the member 85 returns from its stressed position 94 to its normal position 93 in the plane of the body component 65 so as to lock the slide component in place until such time as it is again released by removal of the detent from the aperture 92.

Reference is now made to the embodiment shown in FIGS. 8–14. Here the invention is embodied in a hollow portable container 100 that has a body component 101 and a closure or cover component 102. The cover 102 is secured to the body component 101 by a pair of hinges 103 that permit the cover 102 to pivot between open and closed positions designated at 104 and 105.

The cover 102 of the container 100 is equipped with a latch mechanism 109 for latching the cover in its closed position 105. It includes a latch carrying slide component 110, an assembly 111 or arrangement for mounting the slide component 110 for linear movement on the cover between latched and unlatched positions 112 and 113, and a device 114 for locking the slide component at its latched position 112 shown in FIG. 12.

The body component 101 of container 100 is a rectangular, box-like structure that includes a bottom wall 120, opposite side walls 121 and 122, and front and rear walls 123 and 124. These circumstances, the slide component 21 may be pushed forwardly, as in the direction of arrow 97, without encountering the detent and thus the slide stopping wall edges 87. As this happens, the latch 72 is withdrawn from the body aperture 38 and the slide memeber 85 may then be released to permit the detent 86 to thereafter follow and slidably contact the undersurface 53 of the wall portion 47. As the slide component 21 moves further in the direction of arrow 97, the front sections, such as section 77*a*, of the slide elements 77 and 78 pass to the exterior of the recess 46 at the front of the container. As this happens, the front part 55 of the slide component automatically pivots from its aligned position 59 to its offset position 58 about the pivot axis along the heat coin line 57 in the plane of the body portion. Although the cover may be moved from the closed position 15 to its open position 14 as soon as the latch 72 is withdrawn from the aperture 38, the arrangement enabling the latch carrying front part 55 to pivot to position 58 permits the cover to be closed without damaging the latch even though the slide component 21 has somehow or other returned and become locked at its latched position.

To latch the cover component 12 to the body component 11 of the container 19 when the slide component 21 is in the position seen in FIG. 7, the front part 55 of the slide component is first pivoted downwardly to its aligned position 59 with respect to the rear part 56 of the component. Thereafter, the component 21 is slidably moved in the direction of arrow 98 and until the component walls 120–124 are integrally joined together in a one piece structure that is molded from suitable plastic material in the illustrated embodiment. At its upper end, the body component 101 has a rectangular opening 125 into the hollow interior 126 of the body component. Here and spanning the distance between the opposite side walls 121 and 122 adjacent to the front wall 123 is an elongated, flat cross piece or element 127 that is fixed to these walls and located in the opening to serve as a catch for engagement by the latch when the cover 102 is latched to the body component 101 of the container.

The cover component 102 of the container 100 has a top wall 130 with an exterior surface 103*a*, opposite side walls 131 and 132, and front and back walls 133 and 134. These exterior wall portions 130–134 of the covered component are integrally joined together in a one piece structure that is molded from suitable plastic material in the illustrated embodiment.

The latch carrying slide component 110 is located at the underside 142 of the top wall 130 of cover 102 and it has a generally rectangular planar body portion 137 with inwardly and outwardly facing side faces 138 and 139. At the opposite side edges of the body portion 137, the slide component 110 is equipped with a pair of depending brackets 140 and 141 and which are fixed to the body portion 137 at the underside face 138. Each of these brackets 140 and 141 is provided with a forwardly projecting lug, such as the lug 140*a* on bracket 14. These lugs form a pair of latches which are caught under the cross piece 127 when the slide 110 is in its latched position and the cover is thereby latched to the body 101 of container 100.

The slide body component 137 also has a generally U-shaped slot 145 that extends between the opposite side faces 138 and 139 of the body portion. This provides the elongated, flat, resiliently bendable member 146 of the locking device 114. Member 146 is formed as an integral part of the body portion 137 and in the illustrated embodiment, is integrally joined at its proximal end 147 to the body portion 137 in the process of molding the body portion from suitable plastic material. At its opposite or distal end 148, the member 146 may be deflected from the plane of the body portion 137 as will be subsequently seen.

Between the opposite ends 147 and 148, the bendable member 146 is equipped with a cylindrical button 150 that is integrally joined to the member 146 at the outer side face 139 of the body portion 137. This button 150 aids in depressing the member 146 during use of the locking device 114. Between the opposite ends 147 and 148 of the member 146, the side leg portions of the U-shaped slot 145 are enlarged to accommodate the movement of the button 150 as the member 146 is depressed and moved from its normal unstressed position 151 in the plane of the body portion 137 to its bent or stressed position 152 at which the distal end 148 is deflected laterally inwardly of the plane of the body portion and of the exterior side face 130*a* of wall 130. To limit inward movement of the bendable member 146, the slide component 110 is equipped with a pair of elongated elements 153 and 154 which are fixed at the underside of the body portion 137 across the enlargements in the side legs of the U-shaped slot 145.

The assembly 111 or arrangement for mounting the latch carrying slide component 110 on the cover 102 includes a flat, annular slide component 155 which is arranged for movement at the outside 143 of the top wall 130. This annular component 155 has four cylindrical protuberances or elements 156 that are integrally joined with the slide component in the molding thereof and circumferentially spaced apart about the center hole 157 in the annular component. These elements 156 project through parallel linear slots 158 that extend between the inside 142 and outside 143 of the faces of the top wall 130. The latch carrying slide component 110 is fixed to the protuberances 156 at the underside 142 of wall 130 and the latch carrying slide component movement is limited to a linear path in parallel with the slots 158 as the wall edges at the slots serve to guide and limit the movement of the protuberances 156 through contact therewith. In addition to the slots for the protuberances 156, the top wall 130 also has a large center slot 159 which accommodates the movement of the button 150 during movement of the slide component 110. The button 150 in the assembled latch mechanism projects through slot 159 and into the center hole 157 of the annular slide component as seen in the drawings so as to be conveniently located for manipulation at the exterior side face 130*a* of the container cover wall 130.

In addition to the button carrying bendable member 146, the locking device 114 includes a detent 162 which is fixed to and movable with the member 146, and a recess or aperture arrangement 163 for receiving the detent at the latched position 112 for the slide component so as to lock the latter in place.

The detent 162 is carried at the outwardly facing side face 139 of the planar body portion 137 and is fixed to the distal end 148 of the depressible member 146. The detent 162 is an elongated element that is fixed to member 146 in an arrangement that is transverse to the path of linear movement of the slide component 110 as seen in the drawings.

The top wall 130 is provided with an aperture 166 that is defined by the wall edges 163. The aperture 166 extends between the inside 142 and outside 143 faces of the wall 130 and is transversely arranged to receive the detent 162 when the slide component 110 is at its latched position 112. When the detent 162 is received in the aperture 166, the flat, depressible member 146 is in its normal unstressed position 151 in the plane of the body portion 137 and slide component is locked in place. The detent 162 under such circumstances is supported by the member 146 between the wall edges 163 that define the transversely arranged aperture and serve to stop or arrest movement of the detent 162 along the path of movement for the slide component 110.

To unlock the slide component 110, finger pressure is exerted against the button 150 at the exterior side face 130*a* of the wall 130 so as to bend the resilient member 146 to its bent position 152. At this position the distal end 148 is laterally offset inwardly of the plane of the body portion 157. As the member is moved to its bent position, the detent 162 is withdrawn or pushed from the wall aperture 166 at the underside 142 of wall 130 so as to unlock and free the slide component 110 for movement toward the unlatched position 113.

As the slide component 110 is moved out of its latched position, the finger pressure on the button 150 can be released. When this happens, the detent 162 comes to rest against the surface 167 at the underside 142 of the wall 130. Here, the arrangement is such that the detent 162 follows and remains in sliding contact with the surface 167 as the latch carrying slide component 110 is moved between its latched and unlatched positions 112 and 113. This causes member 146 to be retained at its bent position 152 so that upon return of the slide component to its latched position 112, the member 146 urges and automatically carries the detent 162 into its slide locking position in the aperture 167 as member 146 automatically returns to its normal position under the biasing forces caused by the stressed nature of the resilient bendable member.

Operationally, when the cover 102 is latched in its closed position 105 on the body component 101, the latch forming lugs on the brackets, such as lug 140*a*, are caught under the cross piece 127. This, of course, prevents pivotal movement of the cover to its open position 104. To release the latching mechanism 109, the button 150 is first depressed at the outside 143 of the top wall 130 and to the point at which the resilient member 146 is moved to its bent position 152. This carries the detent 162 at the distal end 148 of member 146 out of the aperture 166 and releases the locking device 114 to permit movement of the latch carrying slide component toward its unlatched position 113. As this happens, the finger pressure on the button 150 may be removed. This will permit the detent to slidably engage and follow the wall surface 167 as the member is moved between its latched and unlatched positions 112 and 113. Under such circumstances, the member 146 is retained in its bent position 152. Movement of the slide component 110 out of the latched position 112 as in the direction of arrow 169 of course draws the latch forming lug from engagement with the catch forming cross piece 127 and this permits one to pivot the cover to its open position 104.

To again unlatch the cover 102 on the body 101 of container 100, the cover 102 is first moved to its closed position 105. The slide component 110 is then slid in the direction of arrow 170 until it reaches its latched position 112. As the slide component 110 moves in the direction of arrow 170, the detent 162 follows the surface 167 of wall 130 and as the slide component enters its latched position 112, the detent 162 becomes aligned with the wall aperture 166. As this happens, the bent member 146 automatically recovers from its resiliently stressed position 152 and is biased back into its normal position 151 in the plane of the body portion 137. This automatically carries the detent 162 into the wall aperture 166 and where the stop forming and recess defining edges 163 prevent further movement of the component 110 and lock it in place.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. In a portable container having a hollow body component with an opening to the exterior thereof, a closure component closing the opening of the body component, and a latching mechanism latching the closure component to the body component, the improvement wherein said closure component has a wall with an exterior side face, said mechanism comprises a latch carrying slide component with a planar body portion that has opposite side faces and is located inwardly of said exterior side face, means mounting the slide component for linear sliding movement on the wall of said closure component between latched and unlatched positions therefor, and a device releasably locking the slide component at its latched position, said device including an elongated, flat, resiliently deflectable member which has proximal and distal ends and is joined at its proximal end to the planar body portion as an integral part thereof, a detent which is located inwardly of said exterior side face and is fixed to and movable with the deflectable member at one of said opposite side faces, and means which is located laterally of said one side face and has a recess that is arranged to receive the detent when the slide component is at its latched position, thereby to lock the slide component at said latched position, said deflectable member having a normal position at which the member is unstressed and located in the plane of the body portion and also having a bent position at which the member is stressed and the distal end is located laterally inwardly of the plane of the body portion and of the exterior side face of said wall, said member being arranged to assume its normal position as the detent is received in said recess, and said member being arranged for depression and movement into its bent position from its normal position by finger pressure exerted at said exterior side face, and thereby to move the detent out of said recess and release the slide component for movement from its latched position.

2. In a portable container having a hollow body component with an opening to the exterior thereof, a closure component closing the opening of the body component, and a latching mechanism latching the closure component to the body component, the improvement in accord with claim 1 wherein the means having the recess also has a surface that is slidably contacted and followed by the detent during movement of the slide component between its latched and unlatched positions, and wherein the detent and surface are arranged to retain the member at its bent position when the detent is in sliding contact with said surface, whereby said detent is automatically carried into said recess as the slide component assumes its latched position by movement from its bent position to its normal position.

3. In a portable container having a hollow body component with an opening to the exterior thereof, a closure component closing the opening of the body component, and a latching mechanism latching the closure component to the body component, the improvement in accord with claim 1 wherein the latch carried by the slide component is fixed with respect to the plane of the body portion.

4. In a portable container having a hollow body component with an opening to the exterior thereof, a closure component closing the opening of the body component, and a latching mechanism latching the closure component to the body component, the improvement in accord with claim 1 wherein the body component has a fixed catch that is engaged by the latch at the latch position for the slide component, and the latch carried by the slide component is disengaged from the latch and adapted and arranged at the unlatched position therefor to pivotally move with respect to a pivot axis that is parallel with the plane of the body portion.

5. In a portable container having a hollow body component with an opening to the exterior thereof, a closure component closing the opening, and means latching the closure component to the body component, the improvement wherein said closure component has a wall with a planar portion and a recessed portion that is offset inwardly of the planar wall portion, wherein said latching means includes a latch carrying slide component that is mounted on the recessed wall portion for linear sliding movement in parallel with the planar wall portion between latched and unlatched positions therefor, and a device for locking the slide component at its latched position, said slide component having a planar body portion that is arranged in the plane of the planar wall portion and has opposite side faces that respectively face inwardly and outwardly of the closure component, said device including an elongated, flat, resiliently deflectable member which has proximal and distal ends and is joined at its proximal end to the planar body portion as an integral part thereof, a detent which is fixed to and movable with the deflectable member at the inwardly facing side face of the body portion, stop means defining an aperture which is located in the recessed wall portion of the closure component and which is arranged to receive the detent when the slide component is at its latched position, thereby to lock the slide component thereat, said member having a normal position at which the member is unstressed and located in the plane of the body portion, and a bent position at which the member is stressed and the distal end is located laterally inwardly of the plane of the body portion and planar wall portion, said member being arranged to automatically assume its normal position as the detent is received in the aperture defined by said stop means and said member being arranged for depression at the outwardly facing side face of the body portion to deflect the member inwardly to its bent position, thereby to carry the detent out of the aperture and release the slide component for movement from its latched position.

6. In a portable container having a hollow body component with an opening to the exterior thereof, a closure component closing the opening, and means latching the closure component to the body component, the improvement in accord with claim 5 wherein said recessed wall portion has an inwardly facing surface that is slidably contacted and followed by the detent during movement of the slide component between its latched and unlatched positions, and wherein said detent and surface are arranged to retain the member at its bent position when the detent is in sliding contact with said surface, whereby said detent is automatically carried into said aperture by movement of the member from its bent position to its normal position as the slide component assumes its latched position.

7. In a portable container having a hollow body component with an opening to the exterior thereof, a closure component closing the opening, and means latching the closure component to the body component, the improvement wherein said closure component has a wall with a planar portion and a recessed portion that is offset inwardly of the planar wall portion, wherein said latching means includes a latch carrying slide component that is mounted on the recessed wall portion for linear sliding movement in parallel with the planar wall portion between latched and unlatched positions therefor, and a device for locking the slide component at its latched position, said slide component having a planar body portion that is arranged in the plane of the planar wall portion and has opposite side faces that respectively face inwardly and outwardly of the closure component, said device including an elongated, flat, resiliently deflectable member which has proximal and distal ends and is joined at its proximal end to the planar body portion as an integral part thereof, a detent which is fixed to and movable with the deflectable member at the inwardly facing side face of the body portion, stop means defining an aperture which is located in the recessed wall portion of the closure component and which is arranged to receive the detent when the slide component is at its latched position, thereby to lock the slide component thereat, said member having a normal position at which the member is unstressed and located in the plane of the body portion, and a bent position at which the member is stressed and the distal end is located laterally inwardly of the plane of the body portion and planar wall portion, said member being arranged to automatically assume its normal position as the detent is received in the aperture defined by said stop means and said member being arranged for depression at the outwardly facing side face of the body portion to deflect the member inwardly to its bent position, thereby to carry the detent out of the aperture and release the slide component for movement from its latched position, said slide component also having a pair of elongated slide elements which are spaced apart and fixed to the body portion at the inwardly facing side face thereof and in an arrangement that parallels said linear sliding movement, said recessed wall portion having a pair of elongated rail elements which are spaced apart and fixed thereto in an arrangement that also parallels said linear sliding movement, and said slide elements being adapted and arranged to slidably engage the respective rail elements during the linear movement of the slide component between its latched and unlatched positions and to prevent movement thereof laterally of said rail elements during such linear movement.

8. In a portable container having a hollow body component with an opening to the exterior thereof, a closure component closing the opening, and means latching the closure component to the body component, the improvement wherein said closure component has a wall with a planar portion and a recessed portion that is offset inwardly of the planar wall portion, wherein said latching means includes a latch carrying slide component that is mounted on the recessed wall portion for linear sliding movement in parallel with the planar wall portion between latched and unlatched positions therefor, and a device for locking the slide component at its latched position, said slide component having a planar body portion that is arranged in the plane of the planar wall portion and has opposite side faces that respectively face inwardly and outwardly of the closure component, said device including an elongated, flat, resiliently deflectable member which has proximal and distal ends and is joined at its proximal end to the planar body portion as an integral part thereof, a detent which is fixed to and movable with the deflectable member at the inwardly facing side face of the body portion, stop means defining an aperture which is located in the recessed wall portion of the closure component and which is arranged to receive the detent when the slide component is at its latched position, thereby to lock the slide component thereat, said member having a normal position at which the member is unstressed and located in the plane of the body portion, and a bent position at which the member is stressed and the distal end is located laterally inwardly of the plane of the body portion and planar wall portion, said member being arranged to automatically assume its normal position as the detent is received in the aperture defined by said stop means and said member being arranged for depression at the outwardly facing side face of the body portion to deflect the member inwardly to its bent position, thererby to carry the detent out of the aperture and release the slide component for movement from its latched position, said slide component having another planar body portion which is integrally joined to the body portion having said deflectable member and which carries said latch, said other planar body portion being adapted and arranged for pivotal movement about a pivot axis in parallel with the plane of the body portion having said deflectable member when said slide component is at its unlatched position.

9. In a portable container having a hollow body component with an opening to the exterior thereof, a closure component closing the opening, and means latching the closure component to the body component, the improvement wherein said closure has a wall with a planar portion and a recessed portion that is offset inwardly of said planar portion, wherein said latching means includes a latch carrying slide component that is mounted on the recessed wall portion for linear sliding movement in parallel with the planar wall portion between latched and unlatched positions therefor and has a pair of parts that are integrally joined together, and a device for locking the slide component at its latched position, wherein said body component has a catch engageable by the latch at the latched position of the slide component, one of said parts having a planar body portion that is arranged in the plane of the planar wall portion and has opposite side faces that respectively face inwardly and outwardly of the container, said device including an elongated, flat, resiliently deflectable member which has proximal and distal ends and is joined at its proximal end to the planar body portion as an integral part thereof, a detent which is fixed to and movable with the bendable member at the inwardly facing side face of the body portion, and stop means defining an aperture which is located in the recessed wall portion of the closure component and which is arranged to receive the detent when the slide component is at its latched position, thereby to lock the slide component thereat, said member having a normal position at which the member is unstressed and located in the plane of the body portion, and a bent position at which the member is stressed and the distal end is located laterally inwardly of the plane of the body portion, said member being arranged for depression at the outwardly facing side face of the body portion to deflect the member inwardly to its bent position, thereby to carry the detent out of the aperture and to release the slide component for movement from its latched position, said latch being carried on the other of said parts for engagement with said catch, said other of said parts being pivotally movable with respect to said one of said parts and to an offset position when said slide component is at said latched position, said slide component also having a pair of elongated slide elements which are spaced apart and fixed to the planar body portion at the inwardly facing side thereof and in an arrangement that parallels the linear sliding movement of said slide component, said recessed wall portion having a pair of elongated rail elements which are spaced apart and fixed thereto in an arrangement that also parallels the linear sliding movement of said slide component, and said slide elements being adapted and arranged to slidably engage the respective rail elements during the linear movement of the slide component between its latched and unlatched positions and to prevent movement thereof laterally of said rail elements during such linear movement.

10. In a portable container having a hollow body component with an opening to the exterior thereof, a closure component closing the opening, and means latching the closure component to the body component, the improvement wherein said closure component has a planar wall with an inside surface, wherein said latching means includes a latch carrying slide component that is mounted on said planar wall at said inside surface for linear movement in parallel with the planar wall between latched and unlatched positions, and a device for locking the slide component at its latched position, said slide component having a planar body portion that has opposite side faces which respectively face inwardly and outwardly of the closure component, said device including an elongated, flat, resiliently deflectable member which has proximal and distal ends and is joined at its proximal end to the planar body portion as an integral part thereof, a detent which is fixed to and movable with the bendable member at the outwardly facing side face of the body portion, stop means defining an aperture which is located in said planar wall and which is arranged to receive the detent when the slide component is at its latched position, thereby to lock the slide component thereat, said member having a normal position at which the member is unstressed and located in the plane of the body portion and a bent position at which the member is stressed and the distal end is located laterally inwardly of said planar wall and of the plane of the body portion, said member being arranged to automatically assume its normal position as the detent is received in the aperture defined by said stop means, and said member being arranged for depression and movement into its bent position from its normal position by finger pressure exerted at the outwardly facing side face of the body portion, thereby to carry the detent out of the aperture and release the slide component for movement from its latched position.

11. In a portable container having a hollow body component with an opening to the exterior thereof, a closure component closing the opening, and means latching the closure component to the body component, the improvement wherein said closure component has a planar wall with an inside surface, wherein said latching means includes a latch carrying slide component that is mounted on said planar wall at said inside surface for linear movement in parallel with the planar wall between latched and unlatched positions, and a device for locking the slide component at its latched position, said slide component having a planar body portion that has opposite side faces which respectively face inwardly and outwardly of the closure component, said device including an elongated, flat, resiliently deflectable member which has proximal and distal ends and is joined at its proximal end to the planar body portion as an integral part thereof, a detent which is fixed to and movable with the bendable member at the outwardly facing side face of the body portion, stop means defining an aperture which is located in said planar wall and which is arranged to receive the detent when the slide component is at its latched position, thereby to lock the slide component thereat, said member having a normal position at which the member is unstressed and located in the plane of the body portion and a bent position at which the member is stressed and the distal end is located laterally inwardly of said planar wall and of the plane of the body portion, said member being arranged to automatically assume its normal position as the detent is received in the aperture defined by said stop means, and said member being arranged for depression and movement into its bent position from its normal position by finger pressure exerted at the outwardly facing side face of the body portion, thereby to carry the detent out of the aperture and release the slide component for movement from its latched position, said planar wall having an outside surface, said latching means comprising means mounting the slide component for movement between its latched and unlatched positions and including a second slide component located at the outside surface of said planar wall and means extending through the planar wall and fixed to and inteconnecting the second slide component and said latch carrying slide component, and slot forming means in the planar wall for guiding the means extending therethrough and establishing the linear path of movement for the latch carrying slide component.

* * * * *

UNITED STATES PATENT AND TRADEMARK OFFICE

CERTIFICATE OF CORRECTION

PATENT NO. : 4377303

DATED : March 22, 1983

INVENTOR(S) : Bruce M. McPherson

It is certified that error appears in the above-identified patent and that said Letters Patent are hereby corrected as shown below:

Column 1, Line 42, "unit" should read -- until --;
Column 2, Line 27, "partable" should read -- portable --;
Column 3, Line 60, "side face 40" should read -- side face 40a --;
Line 62, "40-40" should read -- 40-44 --;
Column 5, Line 63, "82" should read -- 92 --;
Column 6, Line 28, after "such" insert the following -- circumstances, the slide component 21 may be pushed forwardly, as in the direction of arrow 97, without encountering the detent and thus the slide stopping wall edges 87. As this happens, the latch 72 is withdrawn from the body aperture 38 and the slide member 85 may then be released to permit the detent 86 to thereafter follow and slidably contact the undersurface 53 of the wall portion 47. As the slide component 21 moves further in the direction of arrow 97, the front sections, such as section 77a, of the slide elements 77 and 78 pass to the exterior of the recess 46 at the front of the container. As this happens, the front part 55 of the slide component

UNITED STATES PATENT AND TRADEMARK OFFICE

CERTIFICATE OF CORRECTION

PATENT NO. : 4377303

DATED : March 22, 1983

INVENTOR(S) : Bruce M. McPherson

It is certified that error appears in the above-identified patent and that said Letters Patent are hereby corrected as shown below:

automatically pivots from its aligned position 59 to its offset position 58 about the pivot axis along the heat coin line 57 in the plane of the body portion. Although the cover may be moved from the closed position 15 to its open position 14 as soon as the latch 72 is withdrawn from the aperture 38, the arrangement enabling the latch carrying front part 55 to pivot to position 58 permits the cover to be closed without damaging the latch even though the slide component 21 has somehow or other returned and become locked at its latched position.

To latch the cover component 12 to the body component 11 of the container 19 when the slide component 21 is in the position seen in Fig. 7, the front part of the slide component is first pivoted downwardly to its aligned position 59 with respect to the rear part 56 of the component. Thereafter, the component 21 is slidably moved in the direction of arrow 98 and until the component --;

Column 6, Line 56, after "These" delete the rest of the column;

UNITED STATES PATENT AND TRADEMARK OFFICE

CERTIFICATE OF CORRECTION

PATENT NO. : 4377303

DATED : March 22, 1983

INVENTOR(S) : Bruce M. McPherson

It is certified that error appears in the above-identified patent and that said Letters Patent are hereby corrected as shown below:

Column 7, delete Lines 1-17 inclusive; Line 18, delete "component"; Line 31, "103a" should read -- 130a --; Line 33, "covered" should read -- cover --; Line 46, "14" should read -- 140 --;

Column 14, Line 6, after "side" insert -- face --.

Signed and Sealed this

*Sixteenth* Day of *August 1983*

[SEAL]

*Attest:*

GERALD J. MOSSINGHOFF

*Attesting Officer*

*Commissioner of Patents and Trademarks*